US010766761B2

(12) United States Patent
Kojima et al.

(10) Patent No.: US 10,766,761 B2
(45) Date of Patent: Sep. 8, 2020

(54) THREE-DIMENSIONAL FILAMENTS-LINKED STRUCTURE MANUFACTURING APPARATUS, MANUFACTURING METHOD OF THREE-DIMENSIONAL FILAMENTS-LINKED STRUCTURE, AND MATTRESS CORE MATERIAL

(71) Applicant: AIRWEAVE Inc., Obu-shi, Aichi (JP)

(72) Inventors: Masakazu Kojima, Obu (JP); Masashi Fuchigami, Obu (JP); Takahiro Matsuda, Obu (JP)

(73) Assignee: AIRWEAVE INC., Aichi (JP)

( * ) Notice: Subject to any disclaimer, the term of this patent is extended or adjusted under 35 U.S.C. 154(b) by 251 days.

(21) Appl. No.: 15/577,469

(22) PCT Filed: May 26, 2016

(86) PCT No.: PCT/JP2016/065651
§ 371 (c)(1),
(2) Date: Nov. 28, 2017

(87) PCT Pub. No.: WO2017/122370
PCT Pub. Date: Jul. 20, 2017

(65) Prior Publication Data

US 2018/0148312 A1 May 31, 2018

(30) Foreign Application Priority Data

Jan. 13, 2016 (JP) ..... 2016-004816

(51) Int. Cl.
*B68G 7/02* (2006.01)
*D04H 3/037* (2012.01)
(Continued)

(52) U.S. Cl.
CPC ..... *B68G 7/02* (2013.01); *A47C 27/121* (2013.01); *A47C 27/122* (2013.01);
(Continued)

(58) Field of Classification Search
CPC ..... B68G 7/02
See application file for complete search history.

(56) References Cited

U.S. PATENT DOCUMENTS 3,855,045 A * 12/1974 Brock ..... D04H 3/16 428/198
5,639,543 A * 6/1997 Isoda ..... D04H 3/03 428/220
(Continued)

FOREIGN PATENT DOCUMENTS

CN 1440735 A 9/2003
CN 1735724 A 2/2006
(Continued)

OTHER PUBLICATIONS

International Preliminary Report on Patentability and English translation thereof dated Jul. 26, 2018.
(Continued)

*Primary Examiner* — Matthew J Daniels
*Assistant Examiner* — Wayne K. Swier
(74) *Attorney, Agent, or Firm* — Harness, Dickey & Pierce, P.L.C.

(57) ABSTRACT

A manufacturing apparatus and manufacturing method for manufacturing a three-dimensional filaments-linked structure includes: divided weight information acquisition means which records divided weight information acquired by dividing weight distribution in a height direction of a person in a height axis direction, in correlation with a distance from a top of a head of the person; and three-dimensional linked structure formation means which tangles and fuses filaments
(Continued)

of a thermoplastic resin material extruded from an extruder in a three-dimensional net shape, and forms a three-dimensional filaments-linked structure which is long in a product streaming direction, and the three-dimensional linked structure formation means includes filament density control means which controls filament density in the product streaming direction based on the divided weight information. As a result of the configuration, it is possible to promptly, reliably, and efficiently manufacture products with desired specifications for customers who request products with made-to-order specifications.

8 Claims, 7 Drawing Sheets

(51) Int. Cl.

| | |
|---|---|
| ***A47C 27/12*** | (2006.01) |
| ***A47C 31/12*** | (2006.01) |
| ***D04H 3/16*** | (2006.01) |
| ***D06H 1/02*** | (2006.01) |
| ***D06H 7/02*** | (2006.01) |
| ***D04H 3/03*** | (2012.01) |
| ***B68G 7/04*** | (2006.01) |

(52) U.S. Cl.

CPC ..... *A47C 31/123* (2013.01); *B68G 7/04* (2013.01); *D04H 3/03* (2013.01); *D04H 3/037* (2013.01); *D04H 3/16* (2013.01); *D06H 1/02* (2013.01); *D06H 7/02* (2013.01); *D10B 2403/033* (2013.01); *D10B 2503/00* (2013.01)

(56) References Cited

U.S. PATENT DOCUMENTS

| | | | | |
|---|---|---|---|---|
| 7,630,537 | B2 | 12/2009 | Sato et al. | |
| 2006/0116045 | A1 | 6/2006 | Nishibori et al. | |
| 2008/0242774 | A1* | 10/2008 | Lahann | B82Y 10/00 524/99 |
| 2010/0312211 | A1* | 12/2010 | Bond | D04H 11/00 604/378 |
| 2012/0104646 | A1* | 5/2012 | Takaoka | B29C 48/30 264/165 |
| 2013/0161858 | A1* | 6/2013 | Sasaki | D04H 3/037 264/167 |
| 2013/0189472 | A1 | 7/2013 | Takaoka | |
| 2013/0283530 | A1* | 10/2013 | Main | A47C 27/083 5/600 |
| 2014/0114486 | A1 | 4/2014 | Ponnuhamy | |
| 2015/0087196 | A1* | 3/2015 | Wakui | D04H 3/14 442/328 |

FOREIGN PATENT DOCUMENTS

| | | | | |
|---|---|---|---|---|
| CN | 102959151 | A | 3/2013 | |
| CN | 103328711 | A | 9/2013 | |
| CN | 105193156 | A | 12/2015 | |
| JP | 2000/14717 | A | 1/2000 | |
| JP | 2005/000641 | A | 1/2005 | |
| JP | 2007-151817 | A | 6/2007 | |
| JP | 2010/154965 | A | 7/2010 | |
| JP | 4769980 | B2 | 9/2011 | |
| JP | 4966438 | B2 | 7/2012 | |
| JP | 2013/212317 | A | 10/2013 | |
| JP | 2014/516750 | A | 7/2014 | |
| JP | 3197586 | U | 5/2015 | |
| JP | 2015/107149 | A | 6/2015 | |
| WO | WO-2008143557 | A1 * | 11/2008 | B26D 5/007 |
| WO | WO-2012/066259 | A1 | 5/2012 | |
| WO | WO-2015/110639 | A1 | 7/2015 | |

OTHER PUBLICATIONS

International Search Report PCT/ISA/210 for International Application No. PCT/JP2016/065651 dated Aug. 30, 2016.

Japanese Office Action and English translation thereof dated May 28, 2019.

Japanese Office Acrtion and English translation thereof dated Nov. 5, 2020.

Chinese Office Action and English translation thereof dated Jul. 29, 2019.

* cited by examiner

THREE-DIMENSIONAL FILAMENTS-LINKED STRUCTURE MANUFACTURING APPARATUS, MANUFACTURING METHOD OF THREE-DIMENSIONAL FILAMENTS-LINKED STRUCTURE, AND MATTRESS CORE MATERIAL

TECHNICAL FIELD

The invention relates to a manufacturing apparatus of a three-dimensional filaments-linked structure used for a core material of a mattress overlay and the like, a manufacturing method of a three-dimensional filaments-linked structure, and a mattress core material using a three-dimensional filaments-linked structure.

BACKGROUND ART

Attention has been paid to a three-dimensional filaments-linked structure (hereinafter may also be referred to as 3DF) in which thermoplastic resin fibers in molten states (molten filaments) are linked in a three-dimensional steric net shape, and the three-dimensional filaments-linked structure is used as a core material (a core) of a mattress overlay (mattress pad) which is placed on a top of a conventional mattress, futon, or the like to improve sleep environment more comfortable.

This three-dimensional filaments-linked structure is acquired by extruding a thermoplastic resin material such as polyethylene or polypropylene in shapes of continuous lines (the filaments) from an extruder via plural nozzles, tangling and linking (fusing) these filaments in the three-dimensional net shape, and promptly cooling these filaments in such a state.

The applicant has proposed a manufacturing method of an antidecubitus mattress (see Patent Literature 1 and the like), and in the method, by changing a transfer speed of an endless conveyor which receives the three-dimensional filaments-linked structure immediately after formation of the three-dimensional net, filament density (hardness of the mattress core material) is changed per region (block) at plural stages at an arbitrary position along a longitudinal direction (a height direction) of a sleeper's body.

CITATION LIST

Patent Literature

Patent Literature 1: Japanese Unexamined Patent Publication JP-A 2010-154965

Patent Literature 2: Japanese Examined Patent Publication JP-B2 4966438

SUMMARY OF INVENTION

Technical Problem

By the way, athletes and the like are required to be in the best physical condition on a day of the most important game, and such awareness that improvement in everyday "sleep quality" is essential to maintenance and management of a physical condition has been pervasive among them. In addition, those whose are not the athletes but are interested in the "sleep quality" and the improvement thereof have increased in recent years.

Thus, there is an increase in the number of customers who are no longer satisfied with dispersion of body pressure (distribution of the body pressure) that is achieved by commercially-available ready-made mattress overlays provided by types and thus request a made-to-order product (so-called custom-made product) whose specification is set in detail in accordance with physical constitutions (height, weight, and the like), a body shape, a preference, and the like of each individual, and answering to such requests has been demanded.

However, a manufacturing method of the conventional mattress (the three-dimensional filaments-linked structure) has such a problem that it takes time to manufacture a mattress with optimum hardness distribution, which differs by user, and efficient manufacturing thereof is thus difficult.

An object to the is to provide a three-dimensional filaments-linked structure manufacturing apparatus and a manufacturing method of a three-dimensional filaments-linked structure capable of promptly, reliably, and efficiently manufacturing products with desired specifications for customers who request products with made-to-order specifications as well as a mattress core material using a three-dimensional filaments-linked structure.

Solution to Problem

The invention provides a manufacturing apparatus for manufacturing a three-dimensional filaments-linked structure in which filaments are tangled sterically, including: divided weight information acquisition means which acquires divided weight information per block by dividing weight distribution in a height direction of a person, in virtual planes which are orthogonal to a height axis extending from a top of a head toward a heel of the person and are disposed at specified intervals, the divided weight information acquisition means recording the divided weight information in correlation with a distance of a block in a height axis direction from a starting point of the top of the head; and three-dimensional linked structure formation means which makes an extruder extrude a thermoplastic resin material in continuous lines via plural nozzles, tangles and fuses these filaments of the extruded thermoplastic resin material in a three-dimensional net shape, cools the filaments while transferring the filaments, and forms a three-dimensional filaments-linked structure which is long in a product streaming direction, the three-dimensional linked structure formation means including filament density control means which controls filament density based on the divided weight information recorded in the divided weight information acquisition means, the filament density being a filament density of a region corresponding to each block of the formed three-dimensional filaments-linked structure in the product streaming direction.

In the invention, it is preferable that the three-dimensional linked structure formation means includes: marking material loading means which loads a marking material at a position which is on an upstream side with respect to fusion of the filaments of the thermoplastic resin material in the three-dimensional linked structure formation means; and cutting means which cuts the long three-dimensional filaments-linked structure after being cooled, in a product width direction which is orthogonal to the product streaming direction, and, in conjunction with changing the filament density of the three-dimensional filaments-linked structure in the product streaming direction by the filament density control means, based on the divided weight information, the marking material is loaded by the marking material loading means on a front position on the upstream side with respect to the fusion of the filaments, and the long three-dimensional filaments-linked structure is cut by the cutting means at a predetermined position using the loaded marking material as an indicator.

In the invention, it is preferable that the divided weight information acquisition means and the three-dimensional linked structure formation means are located at locations which are remote from each other, are mutually connected via a communication line, and are configured so that the divided weight information can be transmitted from the divided weight information acquisition means to the three-dimensional linked structure formation means.

The invention provides a method of manufacturing a three-dimensional filaments-linked structure in which filaments are tangled sterically, comprising: a divided weight information acquisition process of dividing weight distribution in a height direction of a person at specified intervals in a direction along a height axis extending from a top of a head toward a heel of the person, measuring and acquiring the weight distribution per block, and recording acquired divided weight information per block in correlation with a distance of a block in a height axis direction from a starting point of the top of the head; and a three-dimensional linked structure formation process of melting a thermoplastic resin material, extruding the molten thermoplastic resin material in continuous lines from plural nozzles, tangling and fusing filaments of the extruded thermoplastic resin material in a three-dimensional net shape, cooling the filaments while transferring the filaments, and acquiring a three-dimensional filaments-linked structure which is long in a product streaming direction, and the three-dimensional linked structure formation process including a filament density control process of increasing or decreasing filament density in accordance with the weight distribution in the height direction of the person based on the divided weight information, the filament density being filament density of a region corresponding to each block in the product streaming direction of the three-dimensional filaments-linked structure formed in the three-dimensional linked structure formation process.

In the invention, it is preferable that the three-dimensional linked structure formation process includes: a marking material loading process of, in conjunction with changing the filament density of the three-dimensional filaments-linked structure in the product streaming direction, based on the divided weight information, loading a marking material which serves as an indicator of a changing position of the filament density, at a position which is on an upstream side with respect to fusion of the filaments of the extruded thermoplastic resin material; and a cutting process of cutting the long three-dimensional filaments-linked structure after being cooled, at a predetermined position in a product width direction which is orthogonal to the product streaming direction and a block division direction, using the loaded marking material as the indicator.

The invention provides a strip-shaped mattress core material, comprising a cut product having a long three-dimensional filaments-linked structure in which filaments are tangled sterically, and having a specified length; and a marking material intermittently inserted along a mattress longitudinal direction into at least one end portion in a mattress width direction of the strip-shaped mattress core material, the marking material serving as an indicator of a longitudinal change in hardness in a thickness direction of the strip-shaped mattress core material.

Advantageous Effects of Invention

According to the three-dimensional filaments-linked structure manufacturing apparatus of the invention, the three-dimensional linked structure formation means, which forms the three-dimensional filaments-linked structure, includes the filament density control means which controls the filament density of the three-dimensional filaments-linked structure in the product streaming direction based on the divided weight information (data) recorded in the divided weight information acquisition means.

In this way, the three-dimensional filaments-linked structure manufacturing apparatus of the invention can handle a body shape and the weight distribution of an individual user in detail in blocks which are divided in the height direction. In addition, the three-dimensional filaments-linked structure manufacturing apparatus of the invention can efficiently manufacture the three-dimensional filaments-linked structure, whose filament density in the product streaming direction is changed, based on the divided weight information.

According to the invention, the three-dimensional linked structure formation means includes: the marking material loading means which loads the marking material on the front position on the upstream side of the position where the filaments of the thermoplastic resin material are fused; and the cutting means which cuts the long three-dimensional filaments-linked structure after being cooled, in the product width direction which is orthogonal to the product streaming direction. Then, in conjunction with changing the filament density of the three-dimensional filaments-linked structure in the product streaming direction by the filament density control means, based on the divided weight information, the marking material is loaded by the marking material loading means on the front position on the upstream side of the position where the filaments are fused, and the long three-dimensional filaments-linked structure is cut by the cutting means at the predetermined position using the loaded marking material as the indictor.

In this way, variations in the filament density in the product streaming direction (a longitudinal direction) can easily and visually be checked. In addition, a loading initiation point and a loading termination point of the marking material respectively correspond to an initiation point and a termination point of the change in the filament density. Therefore, markings, signs, the indicators, or the like by the marking material provide a high degree of accuracy and allow anyone to easily and visually check that the product has specifications as ordered.

According to the invention, the divided weight information acquisition means and the three-dimensional linked structure formation means are preferably located at the locations which are remote from each other, are preferably mutually connected via the communication line, and are preferably configured so that the divided weight information can be transmitted from the divided weight information acquisition means to the three-dimensional linked structure formation means.

In this way, regardless of an installment location (a factory or the like) of the three-dimensional linked structure formation means, the divided weight information can be acquired at a location near the user who requests a made-to-order product. That is, convenience of the user is improved. In addition, a change in the specifications requested by the user or the like can be handled further in detail. By using such information, repeated production and the like can promptly be realized in response to the user's request.

Next, according to the manufacturing method of the three-dimensional filaments-linked structure of the invention, the manufacturing method includes: the divided weight information acquisition process of recording the divided weight information in correlation with the distance of the block in the height axis direction from the starting point of the top of the head; and the three-dimensional linked structure formation process of acquiring the three-dimensional filaments-linked structure which is long in the product streaming direction. The three-dimensional linked structure formation process includes the filament density control process of increasing or decreasing the filament density in accordance with the weight distribution in the height direction of the person based on the divided weight information, the filament density being the filament density of the region corresponding to each block in the product streaming direction of the three-dimensional filaments-linked structure formed in the three-dimensional linked structure formation process.

In this way, for the plurality of users whose heights, body shapes, and the like differ, the three-dimensional filaments-linked structure which has hardness distribution corresponding to the weight distribution of each of the users can efficiently be manufactured in the same procedures. In addition, an acquisition procedure of the divided weight information and a manufacturing procedure based thereon can be standardized in a company. Thus, a personalized order system which can handle a preference of each of the users and can consistently handle receiving of an order to production can be constructed.

According to the invention, the three-dimensional linked structure formation process includes: the marking material loading process of loading the marking material as the indicator of the changing position of the filament density on the front position on the upstream side of the position where the filaments of the extruded thermoplastic resin material are fused in conjunction with changing the filament density of the three-dimensional filaments-linked structure in the product streaming direction, based on the divided weight information; and the cutting process of cutting the long three-dimensional filaments-linked structure after being cooled, at the predetermined position in the product width direction which is orthogonal to the product streaming direction and the block division direction, using the loaded marking material as the indicator.

In this way, similar to what have been described above, a worker can easily and visually check the variations in the filament density in the product streaming direction (the longitudinal direction). In addition, a manufacturer can visually check whether a distance of this change (variation) in the filament density from a longitudinal end portion of the product after being cut (length of an offset section from a mattress end portion to the position of the person's head) and the subsequent changes in the filament density exactly follow settings that are based on the divided weight information.

According to the mattress core material of the invention, the marking material is intermittently inserted along the mattress longitudinal direction into the at least one end portion (edge portion) in the mattress width direction of the strip-shaped mattress core material, which is formed of the three-dimensional linked structure, the marking material serving as the indicator of the longitudinal change in the hardness in the thickness direction of the core material.

In this way, the markings, the signs, the indicators, or the like by the marking material allow anyone to easily and visually check that the mattress core material has the specifications as ordered. In addition, the markings, the signs, the indicators, or the like by the marking material can provide clear and reliable indication of the length of the offset section from the mattress end portion to the position of the head as described above as well as an optimum sleep position, and can also be used as such certification (traceability of the product) or the like that this product (mattress) is surely manufactured in accordance with the personal specifications as ordered.

Furthermore, for example, in the case where the mattress is constituted by putting a cover or the like on the mattress core material, the head position and the like of the user are identified in such a use state, and the user only needs to lie down on the mattress in a normal sleep posture. In this way, the hardness distribution of the mattress (the distribution of the filament density) can match body pressure distribution of the user who has ordered the product. As a result, ideal body pressure dispersion can be replicated reliably.

BRIEF DESCRIPTION OF DRAWINGS

Other and further objects, features, and advantages of the invention will be more explicit from the following detailed description taken with reference to the drawings wherein.

DESCRIPTION OF EMBODIMENTS

A detailed description will hereinafter be made on preferred embodiments of the invention with reference to the drawings.

Figure 1:
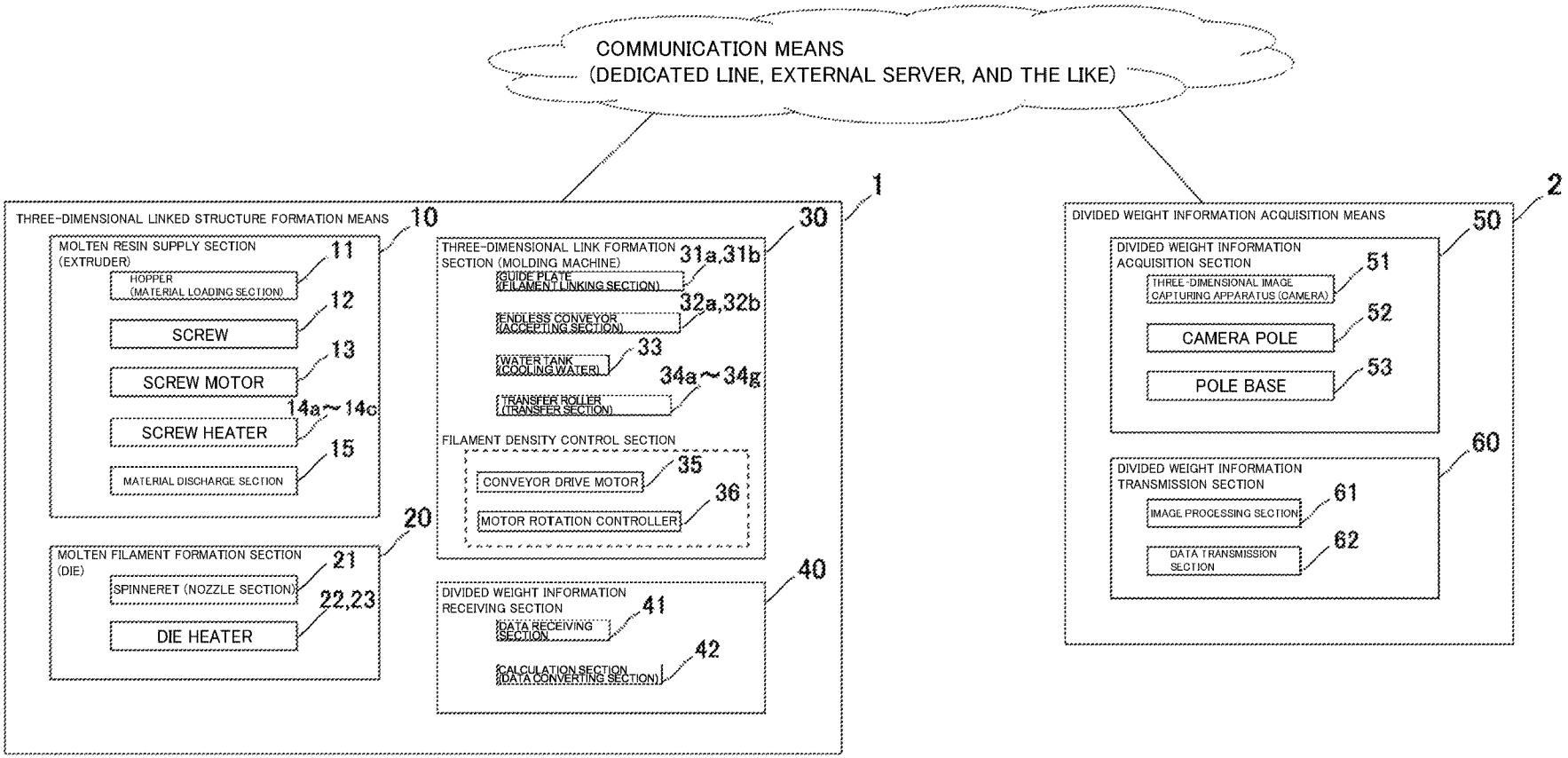
FIG. 1 is a block diagram of a configuration of a three-dimensional filaments-linked structure manufacturing apparatus according to a first embodiment of the invention.

FIG. 1 is a block diagram of a configuration of a three-dimensional filaments-linked structure manufacturing apparatus as a first embodiment of the invention.

As depicted in FIG. 1, the three-dimensional filaments-linked structure manufacturing apparatus of this embodiment includes three-dimensional linked structure formation means 1 and divided weight information acquisition means 2 as primary components which are connected via a communication line, an information server, and the like through which information can be transmitted/received between each other.

Figure 2:
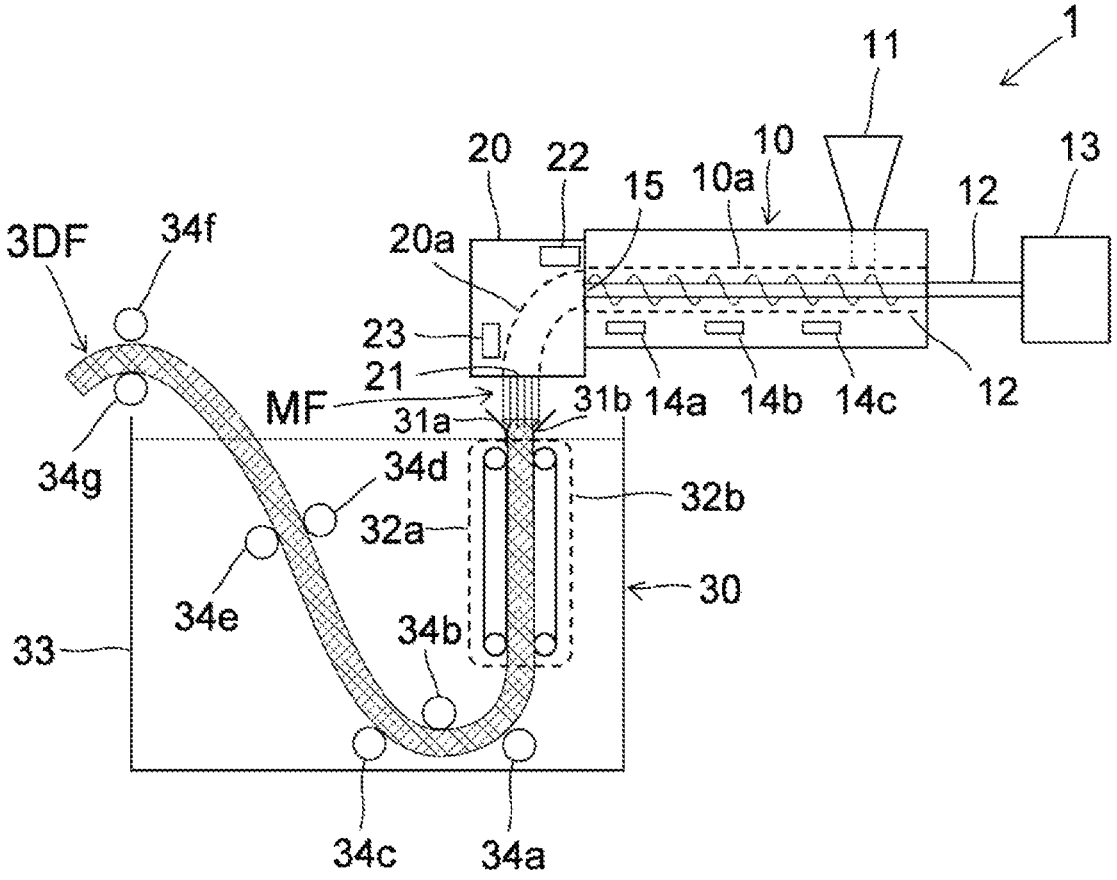
FIG. 2 is a schematic view of a configuration of three-dimensional linked structure formation means in the three-dimensional filaments-linked structure manufacturing apparatus of the first embodiment.

The three-dimensional linked structure formation means 1 comprises: a molten resin supply section (an extruder 10); a molten filament formation section (a die) 20 that includes a spinneret (a nozzle section 21); a three-dimensional link formation section (a molding machine) 30 which includes filament density control means; and a divided weight information receiving section 40 which acquires divided weight information transmitted from the divided weight information acquisition means 2, and specifically has a configuration as depicted in FIG. 2, which will be described below.

Figure 3:
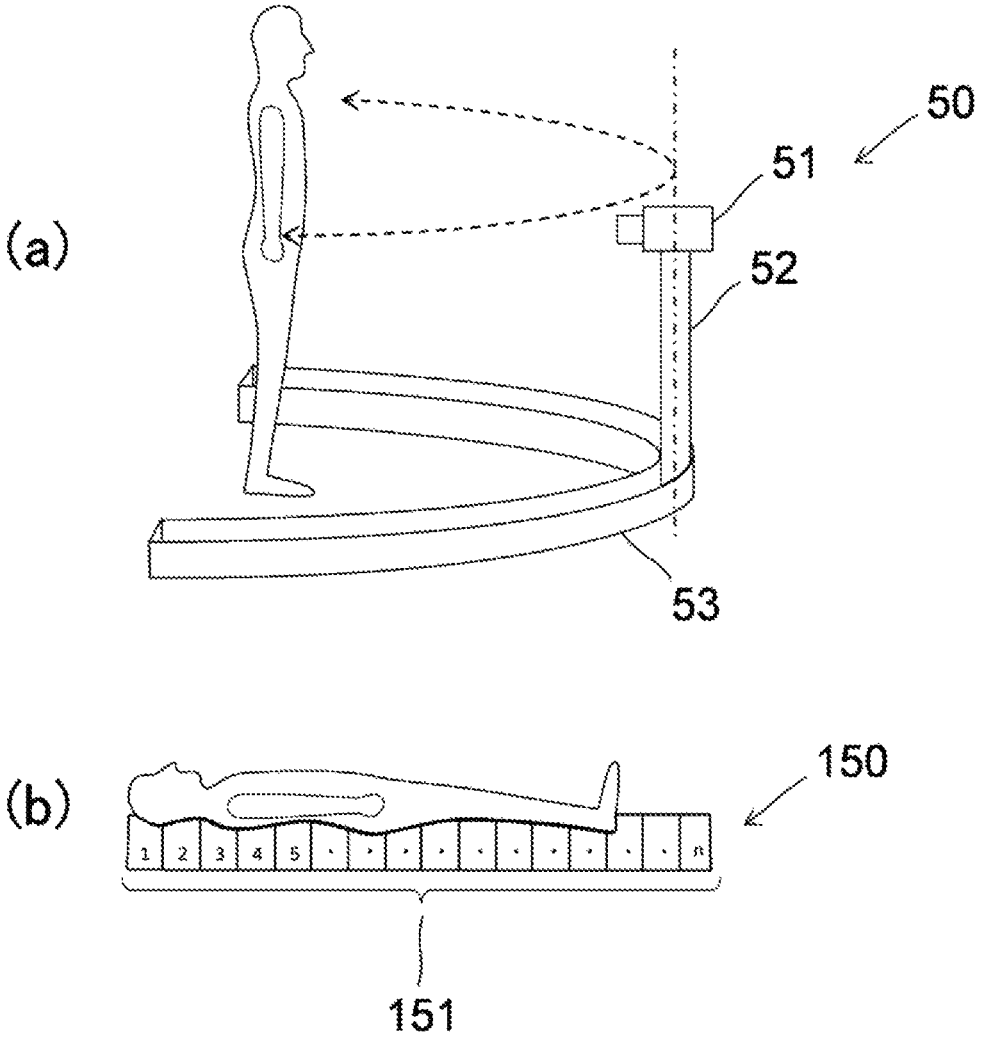
FIG. 3(*a*) is a schematic view showing an example of divided weight information acquisition means, and FIG. 3(*b*) is a schematic view showing another example of the divided weight information acquisition means.

The divided weight information acquisition means 2 uses a method of indirectly acquiring the divided weight information by calculation based on a captured image of a person's body, which is depicted in FIG. 3(*a*), a method of directly measuring the divided weight information by using plural scales or the like as depicted in FIG. 3(*b*), or the like. Note that the first embodiment in FIG. 1 illustrates an example in which the divided weight information acquisition means 2, which adopts the method of calculating the divided weight information from the captured image, is located at a location (for example, a showroom, a sales branch, or the like) which are remote from the three-dimensional linked structure formation means 1 installed in a factory or the like, and is connected to the three-dimensional linked structure formation means 1 via the communication line, the server, and the like.

As depicted in FIG. 2, a specific example (an actual machine) of the three-dimensional linked structure formation means 1 comprises: the molten resin supply section that includes the extruder 10; and a transfer path of a three-dimensional filaments-linked structure (denoted by reference sign 3DF) that is installed in a water tank 33. Here, apparatuses which are not directly involved in manufacturing of the three-dimensional filaments-linked structure, such as communication means including communication cable and control means including a computer, are not depicted in FIG. 2.

The molten resin supply section (the extruder 10) includes a hopper 11 (a material loading section), a screw 12, a screw motor 13, screw heaters 14*a*, 14*b* and 14*c*, and a material discharge section 15. A thermoplastic resin supplied from the hopper 11 is melted in a cylinder 10*a* and is discharged as a molten resin from the material discharge section 15 toward the molten filament formation section 20 (the die).

The molten filament formation section 20 includes: the spinneret having the plural nozzle sections 21; and die heaters 22 and 23. The molten resin which is supplied from the material discharge section 15 (an outlet) of the extruder 10 to a die channel 20*a*, is discharged vertically downward from plural nozzles formed in the nozzle section 21 as molten filaments (denoted by reference sign MF).

The three-dimensional link formation section 30 includes: the water tank 33 which stores cooling water; and endless conveyors 32*a* and 32*b* for cooling the three-dimensional filaments-linked structure (3DF), in which the molten filaments (MF) are tangled and linked in a three-dimensional net shape, while maintaining a three-dimensional (steric) shape and a thickness thereof. Support plates (inclined guide plates 31*a* and 31*b*) which promote retention of the molten filaments (MF) are each provided at a position which is immediately below the plural nozzles and above a position between the endless conveyors 32*a* and 32*b*. The molten filaments are once (momentarily) retained and overlap each other on upper surfaces of these guide plates 31*a* and 31*b*. In this way, the molten filaments (MF) are tangled and linked.

Then, the molten filaments (MF), which have acquired the three-dimensional shape at the position between the inclined guide plates 31*a* and 31*b*, are received between the endless conveyors 32*a* and 32*b* at a specified speed by the endless conveyors 32*a* and 32*b* driven by the conveyor drive motor 35 (not depicted), and are cooled while maintaining a state where the thickness thereof is fixed.

Note that, because a streak of each of the filaments is low in specific gravity and thus floats on water, the endless conveyors 32*a*, 32*b* are installed in water. Then, these filaments which are floating on water are sandwiched between the endless conveyors 32*a* and 32*b* and are pulled downward (in water) to form a continuous (long) net-like structure (three-dimensional filaments-linked structure).

The endless conveyors 32*a* and 32*b* are each formed by making a single endless belt run around a pair of upper and lower rollers. The conveyor drive motor 35 which drives the endless conveyors 32*a* and 32*b* is controlled by a motor rotation controller 36 (the "filament density control means" in this embodiment), which is not depicted, and rotates at a specified angular velocity. As the endless belt, an endless belt (a slat conveyor) in which a metal plate material is fixed to an endless chain or an endless belt in which a metal mesh is fixed to the endless chain can be used. Filament density control by the motor rotation controller 36 will be described below.

Next, as depicted in FIG. 2, the three-dimensional filaments-linked structure (3DF) which is discharged into water from lower ends of the endless conveyors 32*a* and 32*b*, is completely cooled as passing through the transfer path which is defined by transfer rollers 34*a*, 34*b*, 34*c*, 34*d* and 34*e* in the water tank 33, and is taken out of the water tank 33 by transfer rollers 34*f* and 34*g*, each of which has drive power.

The long three-dimensional filaments-linked structure (3DF), which is taken out of the water tank 33, is guided to a workbench (not depicted) where a worker stands by, is cut in a product width direction by a cutter with rotary blades or the like (the "cutting means" in this embodiment), so as to acquire constant length in a product longitudinal direction. In this way, a single strip-shaped three-dimensional filaments-linked structure product (a mattress core material) is manufactured.

The manufacturing apparatus and manufacturing method of the three-dimensional filaments-linked structure in the first embodiment with the above configurations are characterized in that the three-dimensional link formation section (molding machine) 30 has the filament density control means (a filament density control process) which is operable based on the divided weight information.

In this embodiment, this filament density control means comprises: the conveyor drive motor 35 for the endless conveyors 32*a* and 32*b* which receive the molten filaments (MF); the motor rotation controller 36 which controls a rotational speed of this conveyor drive motor 35; and the computer (a data receiving section 41, a calculation section 42, and the like) which transmits control data to the motor rotation controller 36, the control data being obtained by converting the divided weight information.

Note that, in this embodiment, the three-dimensional link formation section (the molding machine) 30 of the three-dimensional filaments-linked structure manufacturing apparatus is configured to control the filament density of the three-dimensional linked structure in accordance with receiving speeds of the endless conveyors 32*a* and 32*b* as described above. Thus, the filament density control means includes the conveyor drive motor 35 and the motor rotation controller 36. However, in a case of a manufacturing apparatus which is configured to control the filament density in another manner, means used as the control means (sections in the apparatus) differ.

For example, in the case where the density is controlled by a supply amount (a discharge amount) of the molten filaments, the density can be controlled by controlling a rotational frequency of the screw motor 13. In addition, in the case where the density is controlled in accordance with a diameter (ϕ) of the filament, the density can be controlled by changing a bore diameter of the spinneret (the nozzle section 21), a distance between the spinneret and each of the guide plates 31*a* and 31*b*, a distance from the spinneret or one of the guide plates 31*a* and 31*b* to a water surface of the water tank 33, and the like, in addition to the rotational frequency of the screw motor 13. Furthermore, in the case where the density is controlled in accordance with total thickness (the thickness in a thickness direction) of the three-dimensional filaments-linked structure, the density may be controlled by adjusting a space between the endless conveyors 32*a* and 32*b* or adjusting a water temperature of the water tank 33.

With the above configuration, after manufacturing of a normal product, the three-dimensional filaments-linked structure manufacturing apparatus of this embodiment can successively manufacture a custom-made product (a made-to-order product), whose change in the filament density differs, without changing process conditions. In addition, parts for a process are not changed, and thus a preparation time for changing of the parts, and the like are not required. Additional materials are not consumed, and thus additional waste materials and the like are not produced. Therefore, the manufacturing apparatus and manufacturing method of the three-dimensional filaments-linked structure in this embodiment can efficiently manufacture the made-to-order product.

Note that, as the thermoplastic resin which can be used as the material of the three-dimensional filaments-linked structure in the embodiment of the invention, for example, a polyolefin resin such as polyethylene or polypropylene, a polyester resin such as polyethylene terephthalate, a polyamide resin such as nylon 66, a polyvinyl chloride resin, a polystyrene resin, a thermoplastic elastomer such as a styrene elastomer, a vinyl chloride elastomer, an olefin elastomer, a urethane elastomer, a polyester elastomer, a nitrile elastomer, a polyamide elastomer, or a fluorine elastomer, or the like can be used. In addition, these resins and elastomers can be blended for use.

Next, as described above, the divided weight information acquisition means 2 of this embodiment uses the method of indirectly acquiring the divided weight information by the calculation based on the captured image of the person's body.

FIG. 3(*a*) is a schematic view showing an example of the divided weight information acquisition means 2 used in the three-dimensional filaments-linked structure manufacturing apparatus of this embodiment.

The divided weight information acquisition means 2 includes a divided weight information acquisition section 50 and a divided weight information transmission section 60, and acquires weight distribution in a height direction of the body [which is a height axis direction from a top of a head toward a heel of the person, and is a product streaming (longitudinal) direction] by dividing the weight distribution into blocks in virtual planes which are orthogonal to the height axis and are disposed at specified intervals, records this divided weight information per block in correlation with a distance of the block in the height axis direction from the starting point of the top of the head, and transmits the acquired divided weight information to the divided weight information receiving section (the data receiving section 41) of the three-dimensional linked structure formation means 1 via the communication line and the like.

The divided weight information acquisition section 50 includes: a three-dimensional image capturing apparatus 51 which captures a steric image of the body; a camera pole 52 which supports the three-dimensional image capturing apparatus 51; and a pole base 53 which supports the camera pole 52 in a manner to allow movement thereof in a horizontal direction (a semicircular shape around the person).

The divided weight information transmission section 60 includes: an image processing section 61 which converts image data acquired by the three-dimensional image capturing apparatus 51 to the steric image (coordinate information of the body) and then computes the divided weight information which is correlated with the distance from the starting point (the top of the head) in a body longitudinal (the height axis) direction; and a data transmission section 62 which transmits the divided weight information to the three-dimensional linked structure formation means 1 installed in the factory or the like via the communication line, the server, and the like.

Next, a description will be made on an acquisition method of the divided weight information by using the divided weight information acquisition means 2 (the three-dimensional image capturing apparatus 51) and use of the divided weight information, that is, how to apply the divided weight information to manufacturing of the three-dimensional filaments-linked structure in the three-dimensional linked structure formation means 1.

Figure 4:
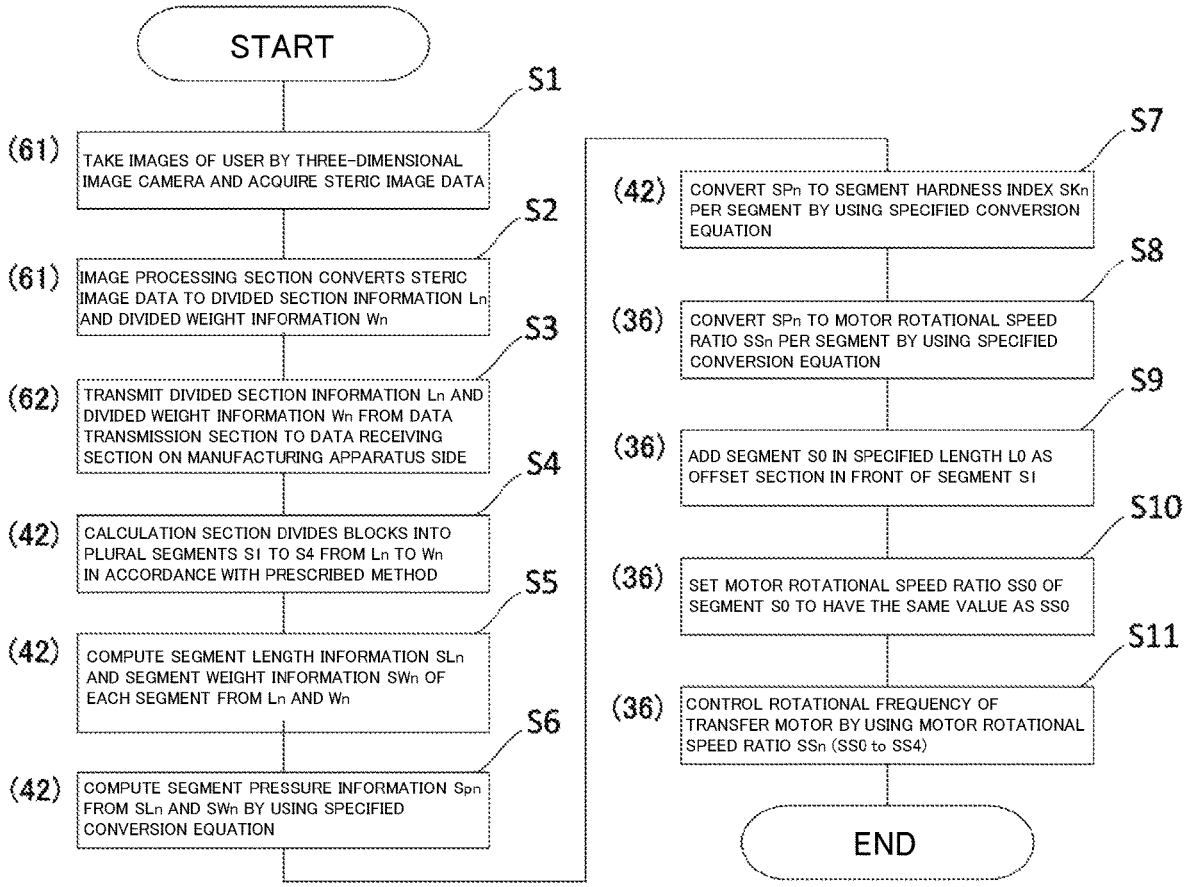
FIG. 4 is a flowchart showing an example of a manufacturing procedure of the three-dimensional filaments-linked structure in the first embodiment.
Figure 5:
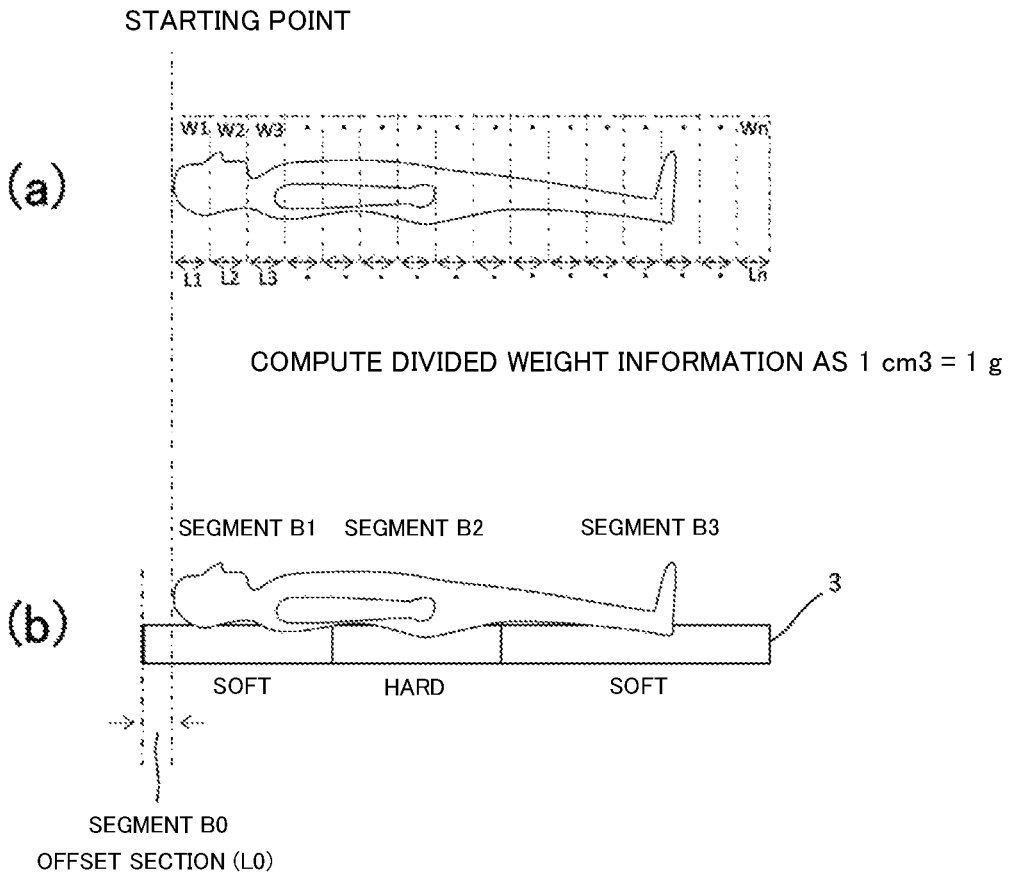
FIG. 5(*a*) is a view showing a computation method of the divided weight information, and FIG. 5(*b*) is a view for explaining an example in which the divided weight information is converted to a manufacturing condition of the three-dimensional filaments-linked structure.

FIG. 4 is a flowchart showing an example of a manufacturing procedure of the three-dimensional filaments-linked structure in the first embodiment. FIG. 5(*a*) is a view showing a computation method of the divided weight information, and FIG. 5(*b*) is a view for explaining an example in which the divided weight information is converted to a manufacturing condition (the change in the filament density). Note that the divided weight information (data) is sequentially processed in each of the sections while being transmitted among the means (or the "sections" representing parts of the apparatus). Accordingly, each block of the flowchart is denoted by the same reference sign as that in the block diagram of FIG. 1 in parentheses at an upper left corner, so as to clarify the processing section. In order to avoid an overlapping description, the description of a function of each of the sections will be omitted.

In the manufacturing method of this embodiment, in step S1, the three-dimensional image capturing apparatus (a camera) 51 takes the images of a user and acquires steric image data of the body (coordinate data of the body). At this time, an upright posture is preferred as a posture of the user during capturing of the images because the upright posture is close to an ideal sleep posture. Note that, in the case where the image data of the sleep posture is acquired, arm weight does not directly affect body pressure distribution of a lower back portion and an abdominal portion. Thus, the image data of the arm portion may be removed from the steric image data of the body.

Next, in step S2, the image processing section 61 divides the steric image data into prescribed specified sections from the top of the head which is the starting point (a section between the two planes which are perpendicular to the body longitudinal direction), and computes a volume in each of the sections (divided volume information). Thereafter, the divided weight information is computed by assuming the specific gravity as one and is converted to divided section information Ln and divided weight information Wn [see FIG. 5(*a*)].

Next, in step S3, the divided section information Ln and the divided weight information Wn, which have been acquired, are transmitted from the data transmission section 62 to the data receiving section 41 of the three-dimensional linked structure formation means 1.

In step S4, the calculation section 42 of the divided weight information receiving section in the three-dimensional linked structure formation means 1 performs data processing on the divided section information Ln and the divided weight information Wn, and divides the information into plural segments B1 to B4 in accordance with a predefined method [see FIG. 5(*b*) and "Table 1"].

In this embodiment, as illustrated in following "Table 1", for example, a group of obtained detailed pieces of divided weight information (the plural blocks) is referred to as the "segment", and the filament density is controlled per this segment.

from the top of the head to 60% thereof as B2, a length section from 60% of the height from the top of the head to 100% thereof as B3, and a remaining section as B4 (a division method 1). However, the number of segments to be divided and the division method are not limited thereto, and thus another method may be adopted.

As other methods of dividing the sections into the plural segments, for example, a method of defining a length section from the top of the head (the starting point) to 30% of accumulated weight as B1, a length section from 30% of the accumulated weight from the top of the head to 60% thereof as B2, a length section from 60% of the accumulated weight from the top of the head to 100% thereof as B3, and a remaining section as B4 (a division method 2), a method of defining each of the sections of the divided weight information as one segment, that is, a method of matching the number of the divided sections and the number of the segments (a division method 3), and a method of computing the segments from the height and weight information by a prescribed method, for example, a method of defining the

TABLE 1

| Distance from starting point A(cm) | Accumulated weight from starting point B(kg) | Divided section information Ln(cm) | | Divided weight information Wn(kg) | | Segment division Defined method 1 | Segment length information SLn(cm) | Segment weight information SWn(kg) | Segment pressure information SPn (=SWn/SLn) (kg/cm) | Segment hardness index SKn (=SPn × 0.3 + 0.92) (*: Formulate conversion equation from experiment data in advance) | Motor rotational speed ratio (Prescribed rotational speed ratio) SSn (=1/SKn) |
|---|---|---|---|---|---|---|---|---|---|---|---|
| 5 | 0.5 | 0-5 | L1 | 0.5 | W1 | S1 | 50 | 13.5 | 0.270 | 1.02 | 0.98 |
| 10 | 1.5 | 5-10 | L2 | 1.0 | W2 | | | | | | |
| 15 | 2.5 | 10-15 | L3 | 1.0 | W3 | | | | | | |
| 20 | 3.5 | 15-20 | L4 | 1.0 | W4 | | | | | | |
| 25 | 4 | 20-25 | L5 | 0.5 | W5 | | | | | | |
| 30 | 6 | 25-30 | L6 | 2.0 | W6 | | | | | | |
| 35 | 8 | 30-35 | L7 | 2.0 | W7 | | | | | | |
| 40 | 10 | 35-40 | L8 | 2.0 | W8 | | | | | | |
| 45 | 12 | 40-45 | L9 | 2.0 | W9 | | | | | | |
| 50 | 13.5 | 45-50 | L10 | 1.5 | W10 | | | | | | |
| 55 | 15 | 50-55 | L11 | 1.5 | W11 | S2 | 50 | 30.5 | 0.610 | 1.12 | 0.89 |
| 60 | 17 | 55-60 | L12 | 2.0 | W12 | | | | | | |
| 65 | 20 | 60-65 | L13 | 3.0 | W13 | | | | | | |
| 70 | 24 | 65-70 | L14 | 4.0 | W14 | | | | | | |
| 75 | 28 | 70-75 | L15 | 4.0 | W15 | | | | | | |
| 80 | 32 | 75-80 | L16 | 4.0 | W16 | | | | | | |
| 85 | 35.5 | 80-85 | L17 | 3.5 | W17 | | | | | | |
| 90 | 38.5 | 85-90 | L18 | 3.0 | W18 | | | | | | |
| 95 | 41.5 | 90-95 | L19 | 3.0 | W19 | | | | | | |
| 100 | 44 | 95-100 | L20 | 2.5 | W20 | | | | | | |
| 105 | 46 | 100-105 | L21 | 2.0 | W21 | S3 | 60 | 18 | 0.300 | 1.03 | 0.97 |
| 110 | 48 | 105-110 | L22 | 2.0 | W22 | | | | | | |
| 115 | 50 | 110-115 | L23 | 2.0 | W23 | | | | | | |
| 120 | 52 | 115-120 | L24 | 2.0 | W24 | | | | | | |
| 125 | 54 | 120-125 | L25 | 2.0 | W25 | | | | | | |
| 130 | 56 | 125-130 | L26 | 2.0 | W26 | | | | | | |
| 135 | 57 | 130-135 | L27 | 1.0 | W27 | | | | | | |
| 140 | 58 | 135-140 | L28 | 1.0 | W28 | | | | | | |
| 145 | 59 | 140-145 | L29 | 1.0 | W29 | | | | | | |
| 150 | 60 | 145-150 | L30 | 1.0 | W30 | | | | | | |
| 155 | 61 | 150-155 | L31 | 1.0 | W31 | | | | | | |
| 160 | 62 | 155-160 | L32 | 1.0 | W32 | | | | | | |
| 165 | 62 | 160-165 | L33 | 0.0 | W33 | S4 | 30 | 0 | — | ↑ (same condition as S3) | ↑ (same condition as S3) |
| . | | | . | . | . | | | | | | |
| . | | | . | . | . | | | | | | |
| . | | | . | . | . | | | | | | |
| 190 | 62 | 185 190 | L39 | 0.0 | W39 | | | | | | |

Note that, in this embodiment, there is adopted a method of dividing the sections into four segments by defining a length section from the top of the head to 30% of the height therefrom as B1, a length section from 30% of the height length segment from the top of the head to 30% of the height therefrom as B1, the length section from 30% of the height from the top of the head to 60% thereof as B2, the length section from 60% of the height from the top of the head to 100% thereof as B3, and the remaining section as B4 and computing W1 as 25% of the weight, W2 as 50% of the weight, and W3 as 25% of the weight (a division method 4), and the like are exemplified.

Next, in step S5, segment length information SLn and segment weight information SWn of each of the segments are computed (integrated) from the divided section information Ln and the divided weight information Wn.

Next, in step S6, segment pressure information Spn is computed from the segment length information SLn and the segment weight information SWn by using a specified conversion equation (here, SPn=SWn/SLn).

In step S7, the segment pressure information Spn is converted to a segment hardness index SKn by using a specified conversion equation. In this embodiment, SKn (=SPn×0.3+0.92) is used as the conversion equation. However, because the conversion equation differs depending on specifications of the three-dimensional linked structure formation means 1 or a material of the filaments (the thermoplastic resin), the optimum conversion equation is formulated based on experiment data which is collected in advance. In addition, in this embodiment, the same conversion equation is used for all of the segments. However, a different conversion equation may be formulated for each of the segments.

In step S8, SPn is converted to a motor rotational speed ratio SSn per segment by using a specified conversion equation (here, SSn=1/SKn). In this embodiment, the motor rotational speed ratio SSn is a coefficient for correcting a reference motor rotational speed (BMS) at which specified hardness is acquired, and is expressed as [a transfer motor rotational speed MS=a reference transfer motor rotational frequency BMS×the motor rotational speed ratio SSn]. As a value of the motor rotational speed ratio SSn is increased, the motor rotational speed MS is increased. As the value of the motor rotational speed ratio SSn is decreased, the motor rotational speed MS is decreased.

Next, in step S9, a segment B0 of a specified length L0 is added as an offset section in front of the segment B1 [see FIG. 5(*b*)]. A length of the offset section corresponds to a length of a space above the head at a time when the user lies down on the mattress (a three-dimensional filaments-linked structure 3 as the core material thereof), and is preferably set from 10 cm to 20 cm in general.

Next, in step S10, a motor rotational speed ratio SS0 of the segment B0 (the offset section) is set to have the same value as SS1, and a motor rotational speed ratio SS4 of the segment B4 is set to have the same value as SS3. In this embodiment, the segment B0 and the segment B4 are set to have the same hardness as the segment B1 and the segment B3, respectively. In this way, the hardness of the mattress is not changed in the space above the head and a space below feet. However, such a specification is not particularly limited, and the hardness may be freely set in accordance with a preference.

Finally, in step S11, the rotational frequency of the conveyor drive motor 35 is controlled by using the motor rotational speed ratio SSn (SS0 to SS4). As the motor rotational speed is increased, the filament density is decreased, and the three-dimensional filaments-linked structure (the mattress core material) softens. On the contrary, as the motor rotational speed is decreased, the filament density is increased, and the three-dimensional filaments-linked structure (the mattress core material) hardens. In this way, the made-to-order product in which the hardness distribution of the mattress (the core material) matches the weight distribution of each of the users can be obtained.

Note that, in the first embodiment, the three-dimensional image capturing apparatus 51 which captures the steric image is used as the divided weight information acquisition section 50 of the divided weight information acquisition means 2, and the acquired image is converted to acquire the divided weight information. However, the acquisition method of the divided weight information in the invention is not limited to this, and various methods can be used. For example, as a divided weight information acquisition section 150 of another type, plural scales (pressure gauges) 151 which are horizontally aligned at specified intervals as depicted in FIG. 3(*b*) may be used. In this case, the divided weight information which is transmitted from the divided weight information transmission section 60 connected to the plural scales 151 to the three-dimensional linked structure formation means 1 has an actual measurement value. Thus, step S2 of the manufacturing method of the three-dimensional filaments-linked structure (S2 in the flowchart of FIG. 4) is not executed, and the procedure starts from step S4 of the manufacturing method (S4 in the flowchart of FIG. 4). In addition, pressure sensors may be used instead of the plural scales 151. Because each pressure is preferably measured in a state of the sleep posture, each of the pressure sensors is preferably installed on a mat on which the sleep posture can be maintained.

Furthermore, in this embodiment, after the divided weight information of the user is acquired, the divided weight information is converted to the specified data (the divided section information Ln and the divided weight information Wn) in accordance with the prescribed method, and the converted data is transmitted to the three-dimensional filaments-linked structure manufacturing apparatus side via the communication means, and then, on the three-dimensional filaments-linked structure manufacturing apparatus side, the prescribed method is used to convert the transmitted data to a control parameter (the motor rotational speed ratio SSn) for controlling an operation of the three-dimensional filaments-linked structure manufacturing apparatus. However, the data which is transmitted via the communication means is not particularly limited as long as a standard for the information communication method is decided in advance. The transmitted data may be the acquired divided weight information of the user as is or may be the data which is converted to the control parameter for controlling the operation of the three-dimensional filaments-linked structure manufacturing apparatus. In addition, the divided weight information of the user may be the measurement data as is or may be data which is corrected based on the user's request or the like.

Next, a description will be made on a second embodiment of the invention.

Figure 6:
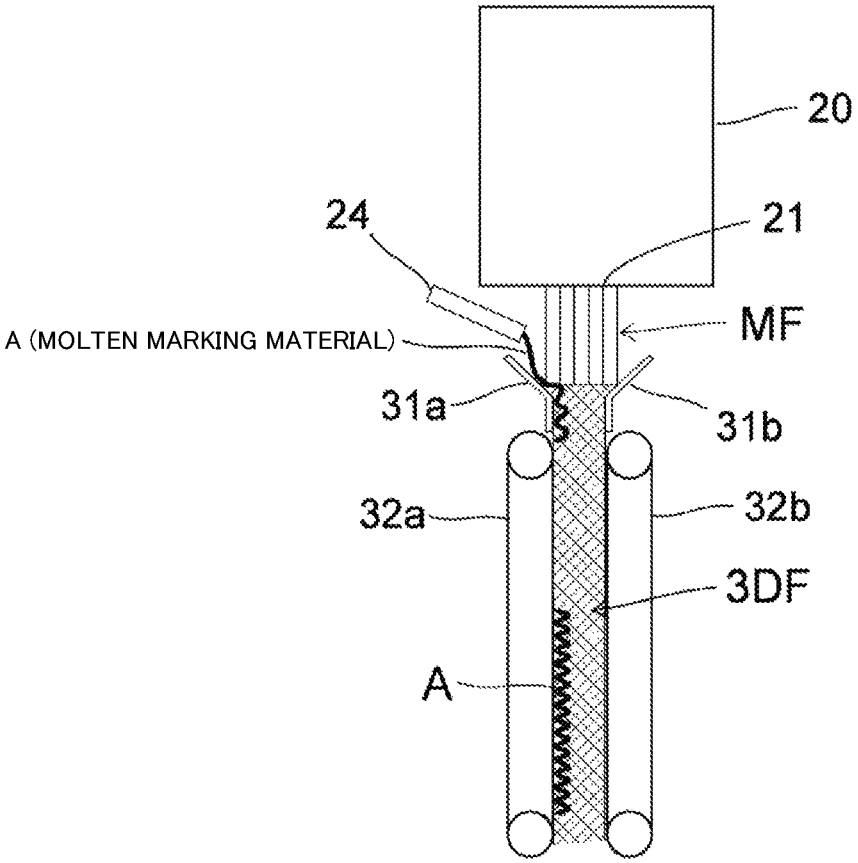
FIG. 6 is a view showing a configuration of a main part of three-dimensional linked structure formation means in a three-dimensional filaments-linked structure manufacturing apparatus of a second embodiment.
Figure 7:
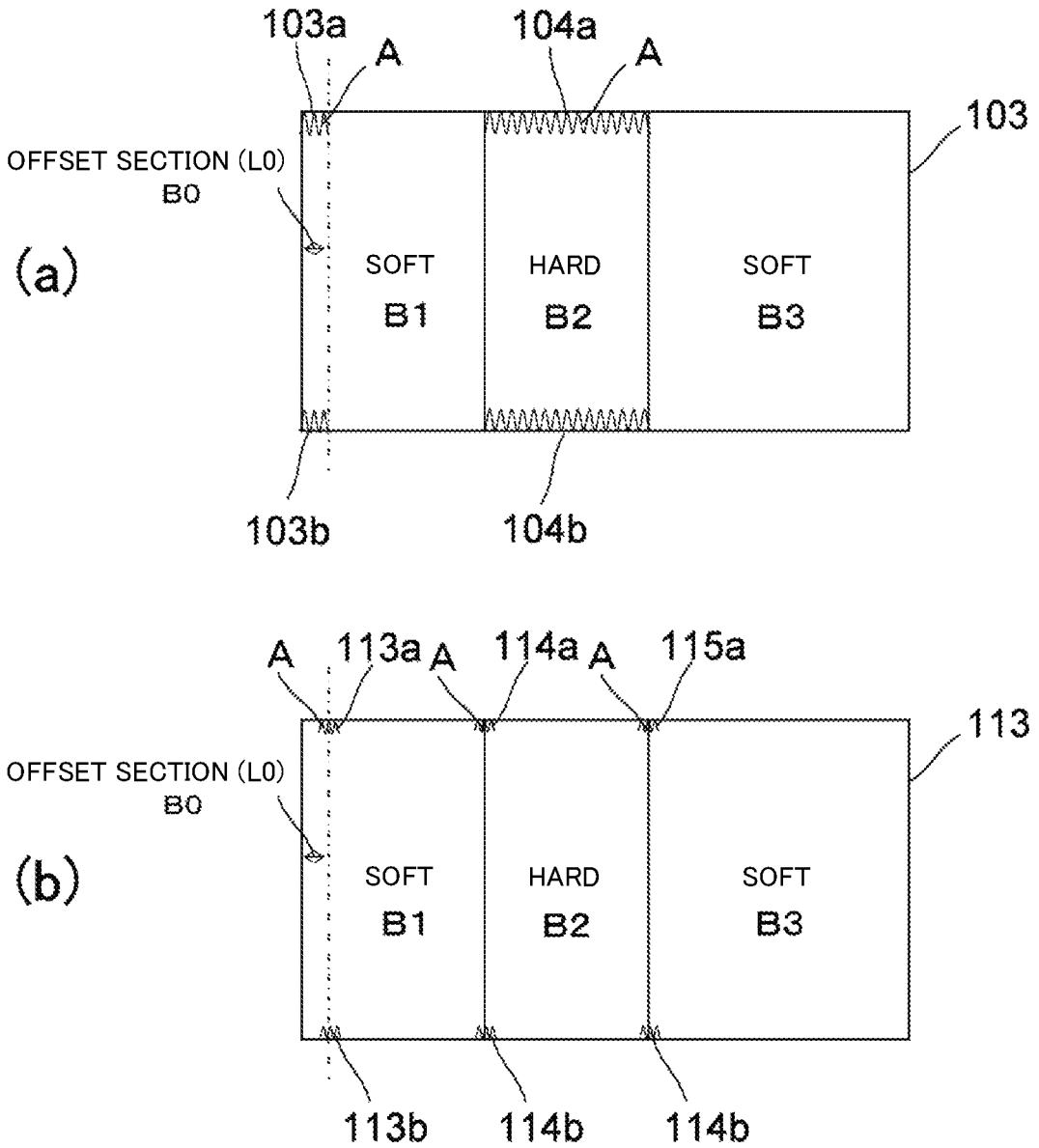
FIGS. 7(*a*) and (*b*) are each a top view of a mattress core material which is formed of a three-dimensional filaments-linked structure acquired by the three-dimensional filaments-linked structure manufacturing apparatus of the second embodiment.

FIG. 6 is an enlarged view showing a main part of three-dimensional linked structure formation means in a three-dimensional filaments-linked structure manufacturing apparatus of the second embodiment. FIG. 7(*a*) and FIG. 7(*b*) are each top views of a three-dimensional filaments-linked structure (a mattress core material) which is obtained by the three-dimensional filaments-linked structure manufacturing apparatus of the second embodiment. Note that, in FIG. 6, components with the same functions as those of the three-dimensional linked structure formation means in the first embodiment are denoted by the same reference signs, and the detailed description thereon will be omitted. FIG. 7(*a*) and FIG. 7(*b*) each depict an example in which a marking material is inserted in both edge portions of the mattress core material by using two units of marking material loading means.

As depicted in FIG. 6, three-dimensional linked structure formation means 1' in the three-dimensional filaments-linked structure manufacturing apparatus of this embodiment differs from the three-dimensional linked structure formation means 1 of the first embodiment in that the marking material loading means (a molten marking material supply nozzle 24) for loading a marking material A different from the molten filament is provided on an upstream side of a position where the molten filaments (MF) are fused, that is, a position which is immediately below the plural nozzles and above (on an upstream side of) the endless conveyors 32*a* and 32*b* and where the support plates (the inclined guide plates 31*a* and 31*b*) for promoting the retention of the molten filaments (MF) are disposed.

In conjunction with changing the filament density of the three-dimensional filaments-linked structure in the product streaming direction by the filament density control means (the motor rotation controller 36, the computer connected thereto, and the like), based on the divided weight information, the marking material is loaded on a changing point of the filament density.

Then, similar to the first embodiment, the long three-dimensional filaments-linked structure (3DF), in which the marking material is inserted, is guided to the workbench (not depicted) where the worker stands by, and is cut in the product width direction at the specified position in the product longitudinal direction by the cutter with the rotary blades or the like (the cutting means) using an insertion position of the marking material as an indicator. In this way, the mattress core material formed of the single strip-shaped three-dimensional filaments-linked structure product is manufactured.

Note that, as the marking material, a thermoplastic resin (polyethylene or the like) which is the same as the material of the molten filament (MF) and which is colored can be used. Alternatively, a material for which a dye, colored particles, or the like is used as a coloring agent, a thread or a string made of natural fiber, artificial fiber, conductive fiber, or metallic fiber, or the like can be used. Of all, a colored resin which is a resin with the same composition as the resin for the molten filament is preferably used as the marking material. This is because a burden of separating the marking material is eliminated at a time when the three-dimensional filaments-linked structure is recycled.

The number of the marking material loading means is not limited. For example, the plural nozzles which respectively correspond to plural colors, plural materials (plural types of material quality), or the like may be provided. In the case where the marking material is powder or a granule, a shooter which can be operated intermittently may be used as the marking material loading means.

In the above example, the three-dimensional linked structure formation means 1' which includes the single molten marking material supply nozzle 24 is exemplified. However, in consideration of ease of visual confirmation and the like during cutting work, the molten marking material supply nozzle 24 may be provided on both sides (the guide plate 31*a* side and the guide plate 31*b* side) of the three-dimensional linked structure formation means 1'.

In mattress core materials 103 and 113, each of which is made of the three-dimensional filaments-linked structure manufactured as above, for example, as depicted in FIG. 7(*a*), the marking material in the corresponding length is inserted in a portion (marking positions 103*a* and 103*b*) which corresponds to the space above the head (the offset section) at the time when the user lies down on the mattress, and a portion (marking positions 104*a* and 104*b*) which has the high filament density and corresponds to a "hard" portion.

As another example, for example, as depicted in FIG. 7(*b*), the marking material may be loaded on a boundary (marking positions 113*a* and 113*b*) between the portion corresponding to the space above the head (the offset section) at the time when the user lies down on the mattress and the subsequent "soft" portion and on boundaries (marking positions 114*a* and 114*b*, and 115*a* and 115*b*) between the "hard" portion and the "soft" portion as the indicators of the changing points of the filament density.

With the above configuration, the worker can visually check variations in the filament density of the acquired three-dimensional filaments-linked structure in the product streaming direction (the longitudinal direction). In addition, a manufacturer can visually check whether a distance of this change (variation) in the filament density from a longitudinal end portion of the product after being cut (the length of the offset section from a mattress end portion to a position of the person's head) and the subsequent changes in the filament density exactly follow settings based on the divided weight information.

In addition, according to the obtained mattress core material (three-dimensional filaments-linked structure) of the invention, markings, signs, the indicators, or the like by the marking material allow the easy visual confirmation of whether the mattress core material has the specifications as ordered. Furthermore, the markings, the signs, the indicators, or the like by the marking material can provide clear and reliable indication of the length of the offset section from the mattress end portion to the position of the head as described above as well as an optimum sleep position.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

REFERENCE SIGNS LIST

1, 1': Three-dimensional linked structure formation means
2: Divided weight information acquisition means
3: Three-dimensional filaments-linked structure
10: Extruder
11: Hopper
12: Screw
13: Screw motor
14*a*, 14*b*, 14*c*: Screw heater
15: Material discharge section
20: Molten filament formation section
21: Spinneret
22: Die heater
23: Die heater
30: Three-dimensional link formation section
31*a*, 31*b*: Guide plate
32*a*, 32*b*: Endless conveyor
33: Water tank
34*a*, 34*b*, 34*c*, 34*d*, 34*e*: Transfer roller
34*f*, 34*g*: Transfer roller
35: Conveyor drive motor
36: Motor rotation controller
40: Divided weight information receiving section

41: Data receiving section
42: Calculation section
50: Divided weight information acquisition section
51: Three-dimensional image capturing apparatus
52: Camera pole
53: Pole base
60: Divided weight information transmission section
61: Divided weight information image processing section
62: Data transmission section
103: Mattress core material
113: Mattress core material
150: Divided weight information acquisition section
151: Scale
A: Marking material
B0: Offset section (Segment)
B1-B4: Segment
S1-S11: Step
MF: Molten filament
3DF: Three-dimensional filaments-linked structure

The invention claimed is:

1. A manufacturing apparatus for manufacturing a three-dimensional filaments-linked structure in which filaments are tangled sterically, comprising:

divided weight information acquisition means for acquiring divided weight information per block, by dividing weight distribution in a height direction of a person, in virtual planes orthogonal to a height axis extending from a top of a head of the person toward a heel of the person and disposed at intervals, the divided weight information acquisition means being further for recording the divided weight information respectively acquired per block, in correlation with a distance of each respective block in a height axis direction from a starting point of the top of the head; and three-dimensional linked structure formation means for making an extruder extrude a thermoplastic resin material in continuous lines via plural nozzles, tangles and fuses filaments of the thermoplastic resin material extruded in a three-dimensional net shape, for cooling the filaments while transferring the filaments, and for forming a three-dimensional filaments-linked structure relatively long in a product streaming direction, the three-dimensional linked structure formation means including filament density control means for controlling filament density based on the divided weight information recorded in the divided weight information acquisition means, the filament density being a filament density of a region corresponding to each respective block of the formed three-dimensional filaments-linked structure in the product streaming direction.

2. The three-dimensional filaments-linked structure manufacturing apparatus of claim 1, wherein the three-dimensional linked structure formation means further includes:

marking material loading means for loading a marking material at a position on an upstream side with respect to fusion of the filaments of the thermoplastic resin material in the three-dimensional linked structure formation means; and cutting means for cutting the relatively long three-dimensional filaments-linked structure after being cooled, in a product width direction, orthogonal to the product streaming direction, and in conjunction with changing of the filament density of the three-dimensional filaments-linked structure in the product streaming direction by the filament density control means, based on the divided weight information, the marking material loading means is configured to load the marking material on a front position on the upstream side with respect to the fusion of the filaments, and the cutting means is configured to cut the relatively long three-dimensional filaments-linked structure at a position, using the marking material when loaded, as an indicator.

3. The three-dimensional filaments-linked structure manufacturing apparatus of claim 1, wherein the divided weight information acquisition means and the three-dimensional linked structure formation means are located at locations remote from each other, are mutually connected via a communication line, and are configured such that the divided weight information is transmittable from the divided weight information acquisition means to the three-dimensional linked structure formation means.

4. The three-dimensional filaments-linked structure manufacturing apparatus of claim 1, wherein the three-dimensional filaments-linked structure is for a core material of a mattress.

5. A manufacturing apparatus for manufacturing a three-dimensional filaments-linked structure in which filaments are tangled sterically, comprising:

3-D image capture apparatus to acquire divided weight information per block, by dividing weight distribution in a height direction of a person, in virtual planes orthogonal to a height axis extending from a top of a head of the person toward a heel of the person and disposed at intervals, including image processor to record the divided weight information respectively acquired per block, in correlation with a distance of each respective block in a height axis direction from a starting point of the top of the head; and three-dimensional linked structure forming apparatus including an extruder to extrude a thermoplastic resin material in continuous lines via plural nozzles, tangles and fuses filaments of the thermoplastic resin material extruded in a three-dimensional net shape, a vessel to cool the filaments while transferring the filaments, to form a three-dimensional filaments-linked structure relatively long in a product streaming direction, a filament density controller to control filament density based on the divided weight information recorded, the filament density being a filament density of a region corresponding to each respective block of the formed three-dimensional filaments-linked structure in the product streaming direction.

6. The three-dimensional filaments-linked structure manufacturing apparatus of claim 5, wherein the three-dimensional linked structure forming apparatus further includes:

marking material supplier to supply a marking material at a position on an upstream side with respect to fusion of the filaments of the thermoplastic resin material; and cutter to cut the relatively long three-dimensional filaments-linked structure after being cooled, in a product width direction, orthogonal to the product streaming direction, and in conjunction with changing of the filament density of the three-dimensional filaments-linked structure in the product streaming direction, based on the divided weight information, the marking material is configured to be loaded on a front position on the upstream side with respect to the fusion of the filaments, and the cutter is configured to cut the relatively long three-dimensional filaments-linked structure at a position, using the marking material when loaded, as an indicator.

7. The three-dimensional filaments-linked structure manufacturing apparatus of claim 5, wherein the 3-D image capture apparatus and the three-dimensional linked structure forming apparatus are located at locations remote from each other, are mutually connected via a communication line, and are configured such that the divided weight information is transmittable from the 3-D image capture apparatus to the three-dimensional linked structure forming apparatus.

8. The three-dimensional filaments-linked structure manufacturing apparatus of claim 5, wherein the three-dimensional filaments-linked structure is for a core material of a mattress.

* * * * *